US008129647B2

(12) United States Patent
Haberer

(10) Patent No.: US 8,129,647 B2
(45) Date of Patent: Mar. 6, 2012

(54) INSULATING NOZZLE, COMPRISING A FIRST MATERIAL AND A SECOND MATERIAL

(75) Inventor: Tommy Haberer, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 504 days.

(21) Appl. No.: 12/373,653

(22) PCT Filed: Jul. 17, 2007

(86) PCT No.: PCT/EP2007/057369

§ 371 (c)(1), (2), (4) Date: Jan. 13, 2009

(87) PCT Pub. No.: WO2008/012238

PCT Pub. Date: Jan. 31, 2008

(65) Prior Publication Data

US 2009/0261070 A1 Oct. 22, 2009

(30) Foreign Application Priority Data

Jul. 24, 2006 (DE) ..... 10 2006 034 742

(51) Int. Cl.
*H01H 33/00* (2006.01)

(52) U.S. Cl. ..... 218/53; 218/72

(58) Field of Classification Search ..... 218/61–64, 218/48–53, 72

See application file for complete search history.

(56) References Cited

U.S. PATENT DOCUMENTS

| | | | | |
|---|---|---|---|---|
| 3,639,712 | A | 2/1972 | Balmat et al. | |
| 4,181,837 | A * | 1/1980 | Browne, Jr. | 218/48 |
| 4,390,764 | A * | 6/1983 | Kriechbaum et al. | 218/65 |
| 4,393,291 | A * | 7/1983 | Stewart et al. | 218/51 |
| 4,420,662 | A | 12/1983 | Niemeyer et al. | |
| 4,445,019 | A | 4/1984 | Gaupp et al. | |
| 4,553,008 | A * | 11/1985 | Veverka et al. | 218/56 |
| 4,798,924 | A * | 1/1989 | Ackermann | 218/43 |
| 5,585,610 | A * | 12/1996 | Meyer et al. | 218/57 |
| 2008/0006608 | A1 | 1/2008 | Saxl et al. | |

FOREIGN PATENT DOCUMENTS

| | | | |
|---|---|---|---|
| CN | 1438665 | A | 8/2003 |
| DE | 2924994 | A1 | 1/1981 |
| DE | 3044836 | A1 | 5/1982 |
| DE | 3811368 | A1 | 11/1988 |
| DE | 19614104 | A1 | 10/1997 |
| EP | 0081253 | A1 | 6/1983 |
| WO | 2006066426 | A1 | 6/2006 |

* cited by examiner

*Primary Examiner* — Truc Nguyen

(74) *Attorney, Agent, or Firm* — Laurence A. Greenberg; Werner H. Stemer; Ralph E. Locher

(57) ABSTRACT

An insulating nozzle is formed with a first and a second material. The first material has a lower erosion resistance than the second material. The insulating nozzle has an insulating nozzle duct. The surfaces defining the insulating nozzle duct are at least partially made out of the second material. The insulating nozzle duct is formed with a hollow cylindrical section. An inner casing surface and an outer casing surface of the hollow cylindrical section is made out of the second material at least partially.

10 Claims, 2 Drawing Sheets

INSULATING NOZZLE, COMPRISING A FIRST MATERIAL AND A SECOND MATERIAL

BACKGROUND OF THE INVENTION

Field of the Invention

The invention relates to an insulating nozzle, comprising a first material and a second material, the first material having a lower erosion resistance than the second material, and a surface defining an insulating nozzle channel comprising the second material.

Such an insulating nozzle is known, for example, from the laid-open specification DE 30 44 836 A1. Said document describes an insulating nozzle for a compressed gas switch, large parts of the insulating nozzle being formed from an electrically insulating material and the insulating nozzle having an electrically conductive insert made from erosion-resistant material so as to form a nozzle constriction. In this case, it is provided that the conductive insert is in the form of a solid complete ring, for example, which is fixed in a cutout of the insulating nozzle there, with the result that the ring made from erosion-resistant material itself forms part of the insulating nozzle channel.

Owing to the use of a conductive insert, improved control of an electrical field is provided. In this case, the insert made from conductive material assumes an electrical potential which cannot be defined in any greater detail. This electrical potential needs to be electrically insulated from further assemblies. It is thus necessary to dimension the insulating nozzle so as to be correspondingly large.

BRIEF SUMMARY OF THE INVENTION

The object of the invention is therefore to specify an insulating nozzle which has good operational properties given compact dimensions.

The object is achieved according to the invention in the case of an insulating nozzle of the type mentioned at the outset by virtue of the fact that the insulating nozzle channel has a hollow-cylindrical section, an inner lateral surface and an outer lateral surface of the hollow-cylindrical section each comprising the second material.

Insulating nozzles are used in electrical switching devices in particular of the medium-voltage, high-voltage and ultra-high-voltage level. Such electrical switching devices are, for example, circuit breakers which are used for switching off operating currents and short-circuit currents. The short-circuit currents can in this case be a multiple of the operating currents. A circuit breaker must therefore be capable of controlling both relatively low currents and very high currents safely. In the event of a switch-off operation, arcs generally occur. Insulating nozzles are used in order to control the blowing of a burning arc with gases. Insulating nozzles surround, for example, an isolation gap between two contact pieces which are capable of moving relative to one another and between which the occurrence of an arc is expected. Depending on requirements, an insulating nozzle channel can be used for the purpose of directing gas which has been heated by the arc and which has expanded in certain directions. The expansion of relatively large gas volumes as a result of the arc is in this case quite desirable. For this reason, the insulating nozzle is manufactured from a suitable first material. This material is generally an organic polymer such as PTFE, for example. When exposed to a high level of heat, for example as a result of an arc, the polymer is gassed and additional switching gas is produced. Owing to the use of a hollow-cylindrical section, the additional switching gas produced can be directed, for example, about one of the contact pieces and brought into a storage volume. It is advantageous in this case to provide a coaxial design of the switching path of the electrical switching device. As a result of the fact that at least parts of the inner or outer lateral surface of the hollow-cylindrical section of the insulating nozzle channel are formed from a second erosion-resistant material, it is no longer readily possible for additional switching gas to be produced there since these regions have increased resistance to thermal effects owing to the increased erosion resistance of the second material. The erosion-resistant material should in this case firstly have only a slight tendency to emit soot. Secondly, soot, possibly generated from other materials, should not adhere as far as possible. Generally, erosion-resistant material is a material which has a low tendency to form soot. This construction makes it possible to retain sections in the insulating nozzle channel in a targeted manner which are provided, for example, for removal of insulating material or for gassing as a result of correspondingly voluminous walls, while other regions, for example a hollow-cylindrical section of the insulating nozzle channel, are provided for directing and conducting switching gases. Such a construction makes it possible to provide the hollow-cylindrical section of the insulating nozzle channel with comparatively thin walls. In particular if the hollow-cylindrical section of the insulating nozzle channel is arranged coaxially with respect to a contact piece, an outer contour of the insulating nozzle which is reduced in circumference can thus be produced. On the other hand, in the region in which the burning of an arc is provided, for example in a cylindrical section of the insulating nozzle channel, a relatively large wall thickness can be made available given an outer circumference of the insulating nozzle which remains the same or is even reduced, and switching gas is released from said wall thickness by thermal effect. It is thus possible to provide a comparatively large volume of insulating material on a narrow insulating nozzle body, which comparatively large volume of insulating material can be gassed without any problems without the stability and functionality of the insulating nozzle being adversely affected. Furthermore, the use of a hollow-cylindrical section of the insulating nozzle provides a sufficient cross section for directing gas which has been heated by the arc and has expanded into a storage volume.

A further advantageous configuration can provide that a lateral surface has an annular region made from the second material.

Annular structures are suitable for protecting, over as large an area as possible in the hollow-cylindrical section of the insulating nozzle channel, the walls/surfaces provided there. The switching gases which have already been heated by the arc and which need to be conducted through the hollow-cylindrical section of the insulating nozzle still have such a heat that they can bring about surface erosion on polymers with a lower erosion resistance. In the process, ring structures protect the correspondingly clad zones of the hollow-cylindrical section of the insulating nozzle channel along the circumference. It can also be provided that a plurality of rings lying one behind the other in an axial sequence are arranged in the inner or outer lateral surface of the hollow-cylindrical section of the insulating nozzle channel. This makes it possible to allow erosion of the regions lying between the rings at certain points. As a result, more precise control of the production of the expanded switching gas to be buffer-stored in the storage volume can take place. It is thus possible to calm down, for example, an overheated switching gas by means of individual regions which can be eroded in the hollow-cylindrical section of the insulating nozzle channel. Overheated switching gases can occur, for example, in the case of high-energy short-circuit currents. Such short-circuit currents are associated with very high-energy arcs, which need to be subjected to particularly intensive cooling. In the case of correspondingly low currents which need to be disconnected and resultant relatively low arc powers, the quenching gas introduced into the hollow-cylindrical section of the insulating nozzle channel is not overheated in such a way that the sections arranged between the rings are additionally eroded. It is thus possible to use switching devices equipped with an insulating nozzle with the configuration according to the invention very frequently for switching operating currents. Furthermore, the insulating nozzle is suitable for controlling short-circuit currents which occur rarely during the life of an electrical switching device.

A further advantageous configuration can provide that regions of the inner lateral surface and of the outer lateral surface, which comprise the second material, overlay one another in the radial direction.

Owing to the fact that radial overlaps of regions which are formed from the second material of increased erosion resistance are provided, favorable ratios in terms of flow technology can be produced in the region of the hollow-cylindrical section of the insulating nozzle channel. In comparison with sections provided increasingly with surface irregularities as a result of erosion phenomena, the mutually opposite regions made from the second material with increased erosion resistance have a smooth surface. It is thus possible for gases conducted through the hollow-cylindrical section to pass said section quickly since the flow resistance of this section is low. Owing to the fact that second materials are arranged radially opposite one another on the inner and outer lateral surfaces, these regions of the insulating nozzle channel have approximately constant flow ratios. Such regions can be formed, for example, by sections which run around the periphery in the form of a ring in the lateral surfaces and which at least partially overlap one another in the axial direction of the hollow cylinder axis.

It can furthermore advantageously be provided that the insulating nozzle is part of an interrupter unit of an electrical switching device, and the hollow-cylindrical section adjoins a cylindrical section of the insulating nozzle channel, the cylindrical section being capable of being blocked by means of a contact piece during a switching operation of the electrical switching device.

In a simple form, a for example cylindrical contact piece can be moved into a cylindrical section of the insulating nozzle channel. In this case, the cylindrical contact piece can have a slightly reduced cross section in comparison with the cross section of the cylindrical section of the insulating nozzle channel. When the contact piece is driven in, the insulating nozzle channel is then blocked. Small amounts of gas can escape only in the edge regions between the contact piece and the wall of the insulating nozzle channel. This makes it possible to control the flow ratios in the insulating nozzle channel. During blocking of the insulating nozzle channel by means of the contact piece, it is possible, for example, for an arc to burn within the cylindrical section of the insulating nozzle channel, which arc heats gases in the region of the cylindrical section and additionally switching gases are produced and expanded as a result of the evaporation of materials defining the insulating nozzle channel. Over the hollow-cylindrical section, which adjoins the side of the cylindrical section of the insulating channel which is remote from the side of the insulating nozzle channel at which the contact piece blocks the insulating nozzle channel, the heated gases can escape through the hollow-cylindrical section. The hollow-cylindrical section of the insulating nozzle channel then opens out, for example, into a storage volume, in which the heated gases are buffer-stored. As a result of the constant afterflow of gases, driven by the arc, the pressure within the storage volume increases. When the contact piece is removed and therefore the insulating nozzle channel is opened, it is made possible for hot gases to flow away out of the insulating nozzle channel. Assisted by the gas under increased pressure within the storage volume, these gases flow in the opposite direction through the hollow-cylindrical section of the insulating nozzle channel in the direction of the cylindrical section of the insulating nozzle channel. An arc which may still be burning there is blown by the gas which is now flowing away. Plasma clouds which may be located in the insulating nozzle channel are forced out of the insulating nozzle channel.

Advantageously, it can further be provided that the second material is embedded in the first material.

The first material with its erosion resistance lower than the second material is, for example, an organic polymer, which forms a greater proportion by volume of the insulating nozzle than the second material. It is therefore advantageous to embed the second material in the first material in such a way that at least individual sections within the hollow-cylindrical section of the insulating nozzle channel are formed from the second material. Chemically or physically treated polymers whose carbon content has been reduced can be used, for example, as the second material. This can be achieved, for example, by radioactive irradiation or thermal treatment.

Furthermore, it can also advantageously be provided that a wall of the insulating nozzle is formed continuously from the second material.

When using the second material for forming a homogeneous wall of the insulating nozzle, joints in the interior of a wall are avoided. As a result, a homogeneous structure is formed which meets stringent dielectric requirements. The second material only needs to be joined to the first material via corresponding connection pads. For this purpose, various joining processes can be used.

A further advantageous configuration can provide that the insulating nozzle has a first nozzle body and a second nozzle body, which are arranged coaxially with respect to one another and between which the hollow-cylindrical section is arranged.

The provision of two nozzle bodies makes it possible in a simple manner to provide the surfaces of the two nozzle bodies, which form the hollow-cylindrical section, with the second material in a suitable form. As a result, simplified production processes can be used. Furthermore, a high degree of flexibility as regards matching of flow properties of the insulating nozzle channel is provided in simple form. A plurality of nozzle basic bodies which can be combined to form an insulating nozzle make it possible to vary the dimensions of the insulating nozzle channel, for example as regards the cross sections of the individual regions of the insulating nozzle channel, or else to corresponding alter the length of the individual sections.

Furthermore, it can advantageously be provided that the two materials are electrically insulating materials.

Owing to the use of electrically insulating materials, the insulating effect of the insulating nozzle per se is barely negatively influenced at all, despite the improved resistance of the hollow-cylindrical section of the insulating nozzle to hot switching gases. Organic polymers, in particular polytetrafluoroethylene (PTFE), are suitable as the first material.

Organic polymers which have been subjected to a special treatment, for example polymers which have been subjected to erosion-resistant particles or polymers from whose surface carbon has already been released by means of a thermal treatment, are suitable as the second material. Furthermore, the polymers may also have been altered by special chemical processes, for example impregnation, in terms of their erosion resistance. Furthermore, ceramics which have good dielectric properties and a high level of erosion resistance can be used as the second material. A suitable ceramic is, for example, $Al_2O_3$.

A further object of the invention is to specify suitable processes which make it possible to cost-effectively manufacture insulating nozzles according to the invention.

The object is achieved according to the invention by virtue of the fact that a molding is shaped from the second or the first material and the first or second material is applied to the molding.

Moldings can be manufactured, for example, by sintering processes from granules. The other material can then be applied to moldings produced in this way in a second step. This makes it possible to produce an intimate bond between the first and the second material. For example, in a further sintering process a joint between the two materials can be produced. In particular when embedding sections of the second material into the first material, with the second material not completely forming a wall of the insulating nozzle, such a process can advantageously be used.

According to the invention, a further process for the manufacture of an insulating nozzle of the type mentioned at the outset is provided in which the first and the second material are each shaped to form moldings, and the moldings are connected to one another.

Owing to the provision of different moldings for the first and the second material, said materials can be produced independently of one another. In this case, for example, sintering processes, casting processes or other suitable shaping processes can be used. The advantage of this manufacturing process is that the insulating nozzle can be completed using different moldings. As a result, the insulating nozzle can be manufactured relatively flexibly from different material combinations in different dimensions.

Exemplary embodiments of the invention will be shown schematically in a drawing below and described in more detail below.

In the drawing:

DESCRIPTION OF THE INVENTION

Figure 1:
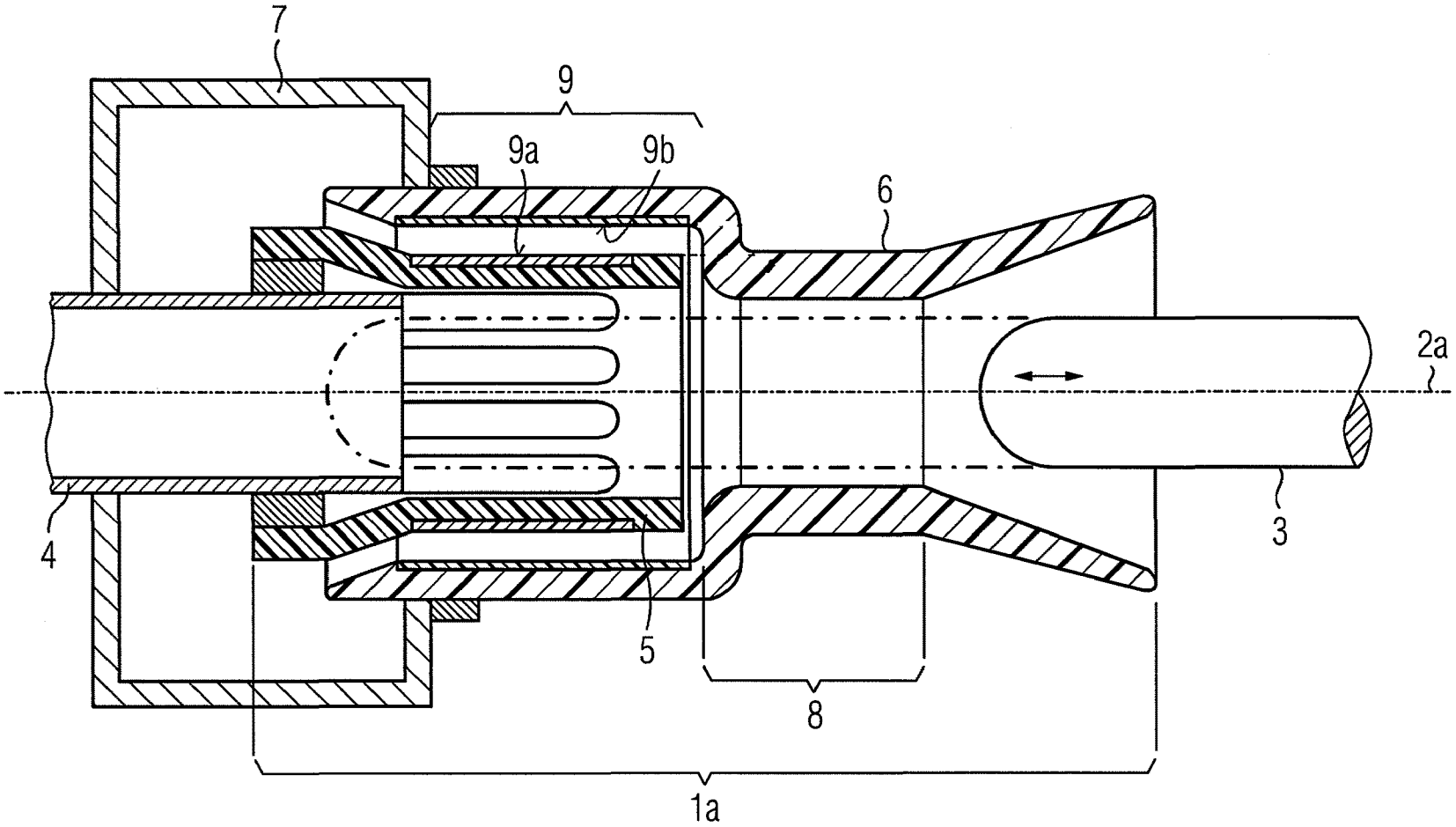
FIG. 1 shows a first variant configuration of an insulating nozzle.

FIG. 1 shows a section through an isolation point of a high-voltage circuit breaker. The isolation point of the high-voltage circuit breaker has a first variant of an insulating nozzle 1*a*. The first variant of the insulating nozzle 1*a* is designed to be coaxial with respect to a longitudinal axis 2*a*. A first contact piece 3 and a second contact piece 4 are likewise arranged coaxially with respect to the longitudinal axis 2*a* in such a way that their end sides lie opposite one another. The first contact piece 3 is capable of moving along the longitudinal axis 2*a* relative to the second contact piece 4. The second contact piece 4 is joined to the first variant of the insulating nozzle 1*a* at a rigid angle. The second contact piece 4*a* has a tulip-shaped contact region, which faces the first contact piece 3. The first contact piece 3 is in the form of a pin and is dimensioned in such a way that it can enter the tulip-shaped contact region of the second contact piece 4.

The first variant of the insulating nozzle 1*a* has an auxiliary nozzle 5 and a main nozzle 6. The auxiliary nozzle 5 is aligned coaxially with respect to the second contact piece 4 and is joined thereto at a rigid angle. The auxiliary nozzle 5 surrounds the tulip-shaped contact region of the second contact piece 4 and envelops it. In addition to the joint at a rigid angle between the auxiliary nozzle 5 and the second contact piece 4, a storage body 7 is joined to the second contact piece 4 at a rigid angle. The storage body 7 has a storage volume for heated gas.

The main nozzle 6 is aligned coaxially with respect to the longitudinal axis 2*a* and surrounds large parts of the auxiliary nozzle 5. The main nozzle 6 is fastened on the storage body 7, with the result that a joint is produced between the auxiliary nozzle 5 and the main nozzle 6 and the first variant of the insulating nozzle 1*a* is formed. The main nozzle 6 has a cylindrical section 8 of an insulating nozzle channel. The cylindrical section 8 widens in the direction of the first contact piece 3. The cylindrical section 8 has a slightly larger cross section than the cross section of the first contact piece 3. At that end of the cylindrical section 8 of the insulating nozzle channel which faces the second contact piece 4, the insulating nozzle channel merges with a hollow-cylindrical section, which opens out into the storage volume made available by the storage body 7. Owing to the regions of the auxiliary nozzle 5 and the main nozzle 6 which overlap one another coaxially, the hollow-cylindrical section of the insulating nozzle channel is formed. Inserts made from a second material are inserted into the auxiliary nozzle 5 and into the main nozzle 6 on the outer lateral surface 9*a* of the auxiliary nozzle 5 and the inner lateral surface 9*b* of the main nozzle 6 in the mutually overlapping region. The auxiliary nozzle 5 and the main nozzle 6 are formed from polytetrafluoroethylene, a first material, over the majority of their volume. The inserts are formed from a second material, which has increased erosion resistance, for example by a ceramic such as $Al_2O_3$. The inserts are in the form of rings and overlap one another in a relatively large region of the hollow-cylindrical section of the insulating nozzle channel.

In order to produce the first variant of the insulating nozzle 1*a*, it can be provided that first a molding is manufactured, either from the first or from the second material, and the corresponding sections of the insulating nozzle which are formed from the second or first material are applied to or introduced into the already existing molding. This can take place, for example, by means of two sintering processes.

The sequence of a switch-off operation will be described in principle below.

In the switched-on state, the first contact piece 3, which has already moved out of the cylindrical section 8 of the insulating nozzle channel in FIG. 1, has entered the tulip-shaped contact region of the second contact piece 4. In the event of a disconnecting movement, the first contact piece 3 is withdrawn from the tulip-shaped contact region of the second contact piece 4. In this case, an arc is produced after DC isolation of the two contact pieces 3, 4 as a result of a high electrical field intensity. Even when the first contact piece 3 is removed further from the second contact piece 4, this arc continues to burn. The arc expands gas in the cylindrical section 8 of the insulating nozzle channel. In addition, it releases switching gas from the walls of the insulating nozzle channel in this region. In this case, that section of the auxiliary nozzle 5 which extends beyond the tulip-shaped contact region in the direction of the cylindrical section 8 is also eroded. Owing to the dimensions of the first contact piece 3, the cylindrical section 8 of the insulating nozzle channel is blocked. The heated and expanded gas or switching gas therefore necessarily needs to flow away into the storage volume of the storage body 7 via the hollow-cylindrical section 9 of the first variant of the insulating nozzle 1. Owing to the fact that the arc continues to be heated constantly and gases are therefore additionally produced and expanded, the pressure in the interior of the storage body 7 increases. Once the hollow-cylindrical section 9 has been released by the first contact piece 3 (corresponds approximately to the illustration in FIG. 1), the hot switching gas buffer-stored in the storage volume flows away in the reverse direction through the hollow-cylindrical section in the direction of the cylindrical section 8 and out of the expanding region of the insulating nozzle channel. In this case, a rapid gas flow results, which forces out plasma clouds which may be located between the contact pieces and cools the arc until the arc is ultimately quenched.

Figure 2:
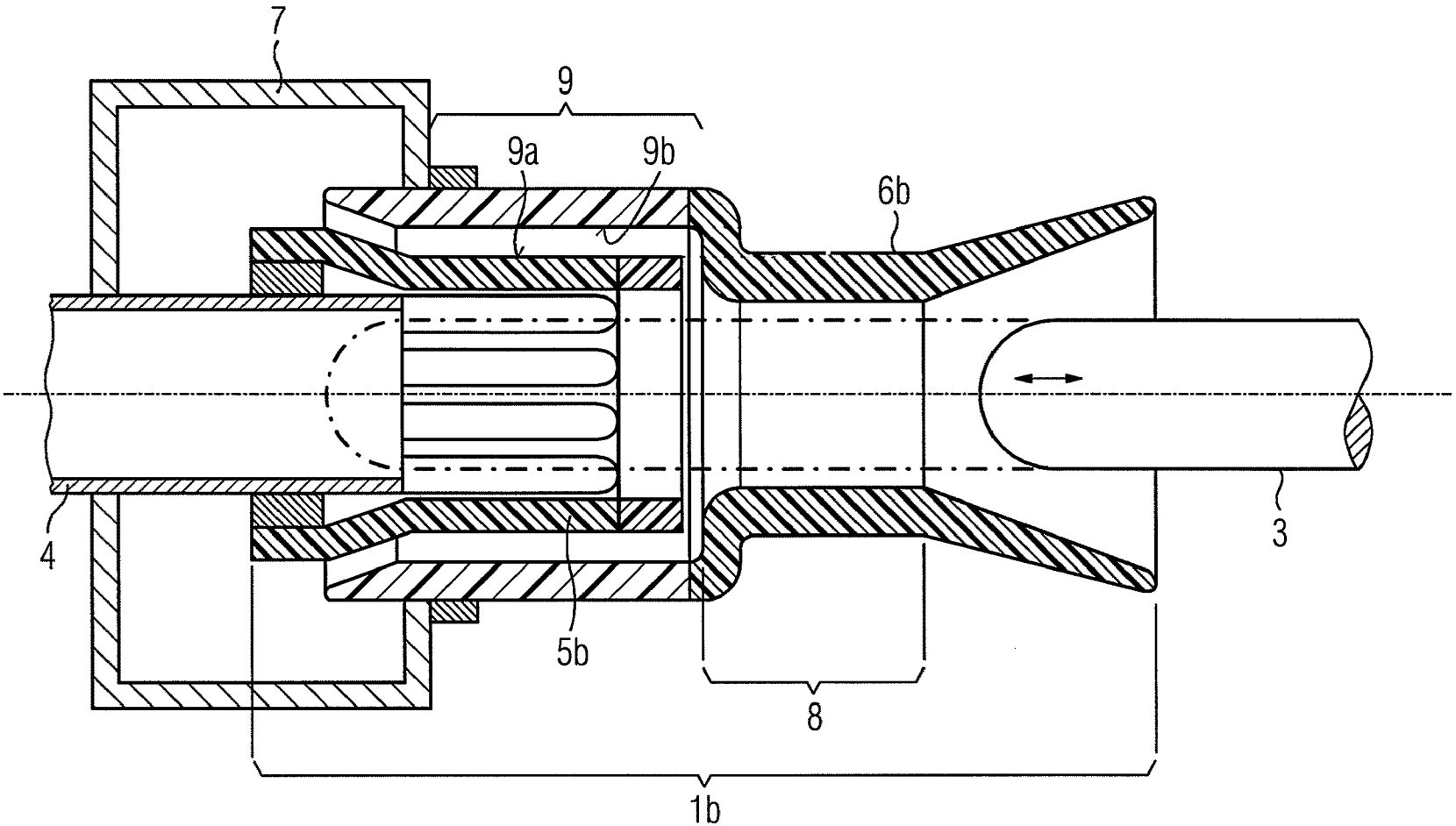
FIG. 2 shows a second variant configuration of an insulating nozzle.

The second variant of an insulating nozzle 1*b* illustrated in FIG. 2 has in principle the same design as the first variant of an insulating nozzle illustrated in FIG. 1. The same assemblies have therefore been provided with the same reference symbols. Only the hollow-cylindrical section 9 with a second material has an alternative configuration.

FIG. 2 shows a section through a second variant of an insulating nozzle 1*b*. Just as the first variant of an insulating nozzle 1*a*, the second variant 1*b* has a main nozzle 6*b* and an auxiliary nozzle 5*b*. The cylindrical section 8, the expanding section of the insulating nozzle channel of the main nozzle 6*b* and that region of the auxiliary nozzle 5*b* which protrudes beyond the contact region of the second contact piece are formed from the first material, i.e. from polytetrafluoroethylene. The section of the main nozzle 6*b* which coaxially surrounds the auxiliary nozzle 5*b* is formed from a second material, i.e. walls of this section of the main nozzle 6*b* are formed completely from a material with an increased erosion resistance. Likewise, a large proportion of the auxiliary nozzle 5*b* is formed from the material with increased erosion resistance. As a result, substantial parts of the hollow-cylindrical region of the insulating nozzle channel which is formed between the main nozzle 6*b* and the auxiliary nozzle 5*b* are defined by material with increased erosion resistance. A manufacturing process can provide, for example, that rotationally symmetrical moldings are produced separately from material with increased erosion resistance and material of reduced erosion resistance, and these moldings are joined to one another at a rigid angle, for example by means of cohesive joining processes, at the corresponding end-side sections.

It can also be provided, for example, to join granules of materials of different erosion resistances to form a common sintered body. For example, a plurality of moldings can be formed which cure in a sintering process and are joined to one another. This has the advantage that the process of joining a plurality of moldings together does not need to take place in one separate step.

The invention claimed is:

1. An insulating material nozzle, comprising:

a nozzle body formed with a first material and a second material, said first material having a lower erosion resistance than said second material;

said nozzle body having an insulating nozzle channel formed therein with a surface defining said insulating nozzle channel containing said second material;

said insulating nozzle channel having a hollow-cylindrical section with an inner lateral surface and an outer lateral surface, said inner lateral surface and said outer lateral surface of said hollow-cylindrical section each containing said second material.

2. The insulating material nozzle according to claim 1, wherein a lateral surface has an annular region made from said second material.

3. The insulating material nozzle according to claim 1, wherein segments of said inner lateral surface and segments of said outer lateral surface formed of said second material overlay one another in a radial direction.

4. The insulating material nozzle according to claim 1, configured to form a part of an interrupter unit of an electrical switching device, and wherein said hollow-cylindrical section adjoins a cylindrical section of said insulating material nozzle channel, and said cylindrical section is configured to be blocked by way of a contact piece during a switching operation of the electrical switching device.

5. The insulating material nozzle according to claim 1, wherein the second material is embedded in the first material.

6. The insulating material nozzle according to claim 1, wherein a wall of the insulating material nozzle is formed continuously from the second material.

7. The insulating material nozzle according to claim 1, wherein said nozzle body includes a first nozzle body and a second nozzle body disposed coaxially with respect to said first nozzle body, and wherein said hollow-cylindrical section is disposed between said first and second nozzle bodies.

8. A method for manufacturing the insulating material nozzle according to claim 1, which comprises: shaping a molding from the second material or from the first material and applying the first material or the second material to the molding to form the nozzle according to claim 1.

9. A method for manufacturing the insulating material nozzle according to claim 1, which comprises: shaping the first material into a first molding, shaping the second material into a second molding, and connecting the first and second moldings to one another to form the nozzle according to claim 1.

10. An insulating material nozzle, comprising:

a nozzle body formed with a first material and a second material, said first material having a lower erosion resistance than said second material, said first material and said second material being electrically insulating materials;

said nozzle body having an insulating nozzle channel formed therein with a surface defining said insulating nozzle channel containing said second material;

said insulating nozzle channel having a hollow-cylindrical section with an inner lateral surface and an outer lateral surface, said inner lateral surface and said outer lateral surface of said hollow-cylindrical section each containing said second material.

* * * * *